US008567577B2

(12) United States Patent
Jackson

(10) Patent No.: US 8,567,577 B2
(45) Date of Patent: Oct. 29, 2013

(54) LUGGAGE AND AIR MATTRESS COMBINATION

(76) Inventor: Valerie D. Jackson, Baltimore, MD (US)

( * ) Notice: Subject to any disclaimer, the term of this patent is extended or adjusted under 35 U.S.C. 154(b) by 515 days.

(21) Appl. No.: 12/877,739

(22) Filed: Sep. 8, 2010

(65) Prior Publication Data

US 2011/0056788 A1 Mar. 10, 2011

Related U.S. Application Data

(60) Provisional application No. 61/272,316, filed on Sep. 10, 2009.

(51) Int. Cl.
*A47C 17/82* (2006.01)
*A45F 4/00* (2006.01)

(52) U.S. Cl.
USPC ..... 190/2; 190/8; 190/18 A; 190/109; 190/110; 190/111; 206/522; 5/705

(58) Field of Classification Search
USPC ..... 190/2, 8, 18 A, 109–111; 5/705, 93.2, 5/99.1; 206/522; 383/3
See application file for complete search history.

(56) References Cited

U.S. PATENT DOCUMENTS

| | | | | | |
|---|---|---|---|---|---|
| 466,194 | A | * | 12/1891 | Snaman, Jr. | 190/2 |
| 2,290,786 | A | | 7/1942 | Varady | |
| 3,133,696 | A | * | 5/1964 | Mirando | 417/479 |
| 3,751,741 | A | * | 8/1973 | Hendry | 5/413 AM |
| 4,890,705 | A | * | 1/1990 | Pineda | 190/18 A |
| 5,076,405 | A | | 12/1991 | Modica | |
| 5,100,198 | A | * | 3/1992 | Baltzell | 312/235.2 |
| 5,611,414 | A | | 3/1997 | Walker | |
| 6,742,635 | B2 | * | 6/2004 | Hirshberg | 190/2 |
| 7,163,262 | B2 | * | 1/2007 | Anglin | 297/217.1 |
| 8,176,588 | B2 | * | 5/2012 | Lin | 5/713 |
| 2007/0062622 | A1 | * | 3/2007 | Groover | 150/113 |
| 2007/0283500 | A1 | | 12/2007 | Chang | |

* cited by examiner

*Primary Examiner* — Tri Mai
(74) *Attorney, Agent, or Firm* — Richard C. Litman

(57) ABSTRACT

The luggage and air mattress combination is a wheeled luggage device including an upper compartment for storage of personal items. A lower compartment houses an inflatable mattress, which can be extended from the lower compartment and pumped up for use as a sleeping or lounging platform. A pump is housed in the luggage and connected to the mattress for inflation thereof. A backrest is also housed adjacent the lower compartment and is extracted therefrom for use. Pivotal arms are positioned adjacent the backrest to enhance the user's comfort. A canopy may be removably attached to the luggage to block out light from the surrounding area and add a modicum of privacy. An insulated liner may be provided for use in the upper compartment for the storage of food, if desired.

18 Claims, 11 Drawing Sheets

LUGGAGE AND AIR MATTRESS COMBINATION

CROSS-REFERENCE TO RELATED APPLICATION

This application claims the benefit of U.S. Provisional Patent Application Ser. No. 61/272,316, filed Sep. 10, 2009.

BACKGROUND OF THE INVENTION

1. Field of the Invention

The present invention generally relates to travel accessories, and more particularly to a luggage and air mattress combination that provides for a wheeled luggage device that incorporates a built-in air mattress that can be extended from the luggage and inflated.

2. Description of the Related Art

The art of travel has become somewhat complicated, especially the art of air travel. Security concerns, overbooking, weather delays, aircraft maintenance issues and the like have often conspired to strand the air traveler in airports for inordinate lengths of time. In many instances, during such delays, it is not feasible to go to a hotel and the air terminal seats are not conducive to waiting in comfort. At such times it would certainly be a boon if a convenient lounging apparatus could be quickly retrieved for use so that the delay, though annoying, could at least be waited out in a degree of comfort. Thus, a luggage and air mattress combination solving the aforementioned problems is desired.

SUMMARY OF THE INVENTION

The luggage and air mattress combination includes a wheeled luggage device having an upper compartment for storage of personal items. A lower compartment houses an inflatable mattress. The mattress can be extracted from the lower compartment and inflated for use as a sleeping or lounging platform. A pump is housed in the luggage and connected to the mattress for inflation thereof. A backrest is also housed in the lower compartment and is extracted therefrom for use. Pivotal arms are positioned adjacent the backrest to enhance the user's comfort. A canopy can be removably attached to the luggage to block out light from the surrounding area and to add a modicum of privacy. An insulated liner may be provided for use in the upper compartment for the storage of food, if desired.

Accordingly, the invention presents a unique luggage device that can be conveniently converted to a lounge or sleeping device if necessary. The luggage device is easy to use, versatile and is quickly converted.

The luggage air/mattress combination would take convenience to another level with campers. The design would eliminate the need to have to carry, separately, a backpack and sleeping bag (or chair) as these items are conveniently incorporated into one unit for easy effortless travel and fun. To further extend the benefit of this combination, the camper would have the ability to replace his/her personal garment lining with the insulated liner to enjoy cold drinks or food. The above-described scenario is also applicable for the currently popular sleepover phenomenon. The addition of a luggage carrier to the ubiquitous air mattress would add even more convenience, making all personal items easily accessible. Another projected use is for fishermen. The need to lug a separate cooler for a large catch would be eliminated in that the invention includes not only a shaded place to sit or lounge but also incorporates an insulated storage bin to house the catch. The above-suggested usages are not limiting, but are merely some of the many uses to which the invention may be applied.

The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
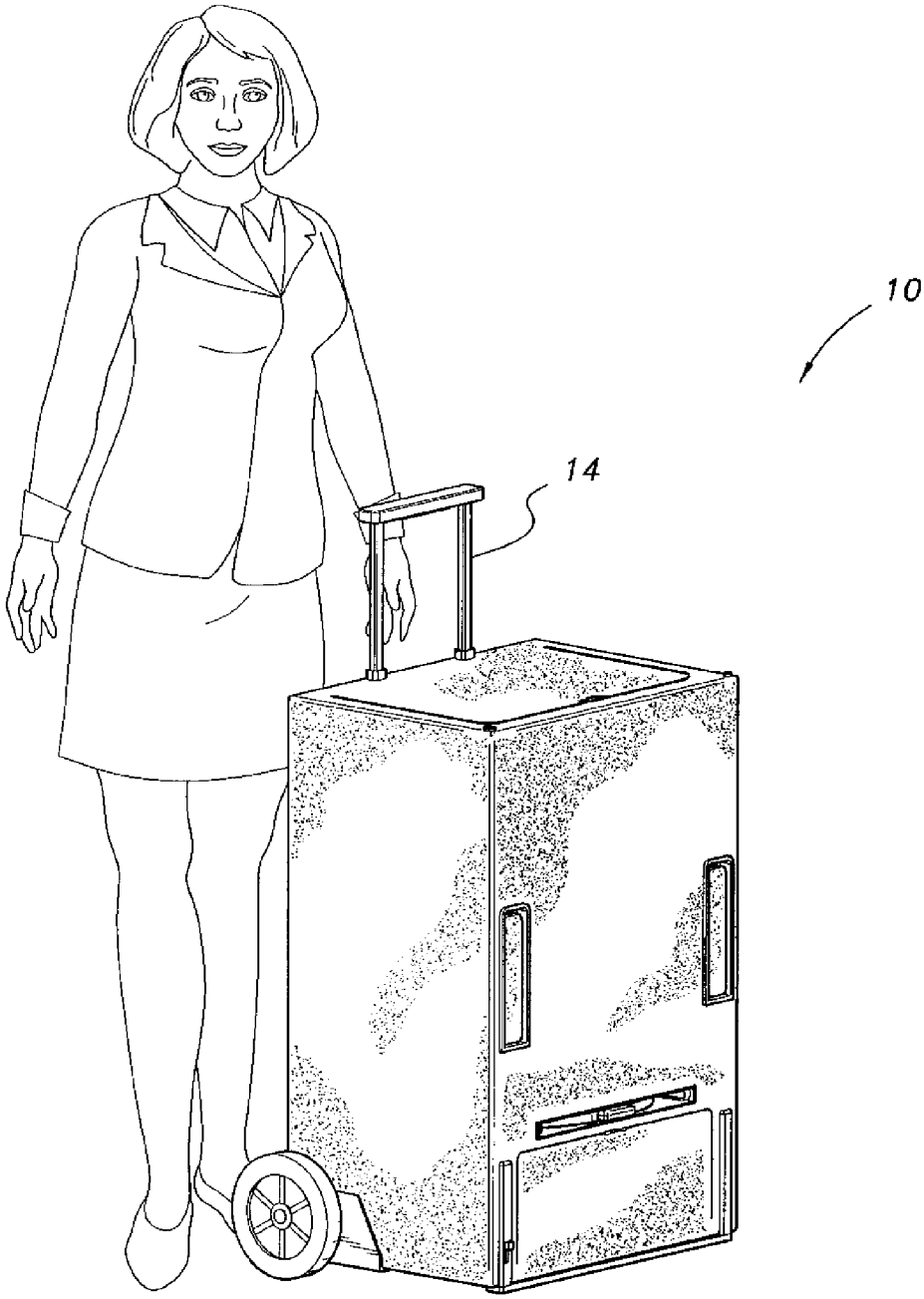
FIG. 1 is an environmental, perspective view of a luggage and air mattress combination according to the present invention.
Figure 1A:
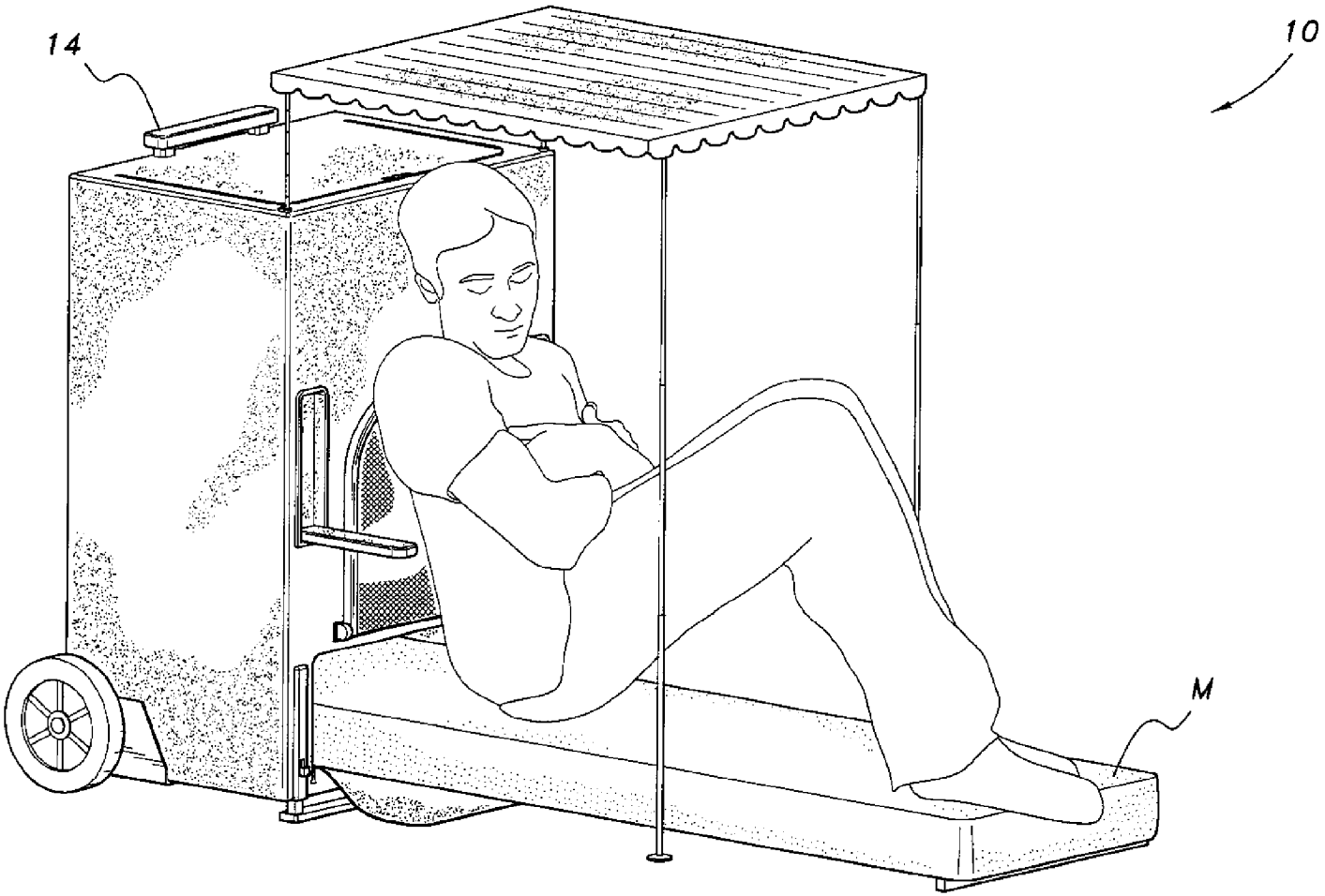
FIG. 1A is an environmental, perspective view of a luggage and air mattress combination according to the present invention with the canopy in place.
Figure 2:
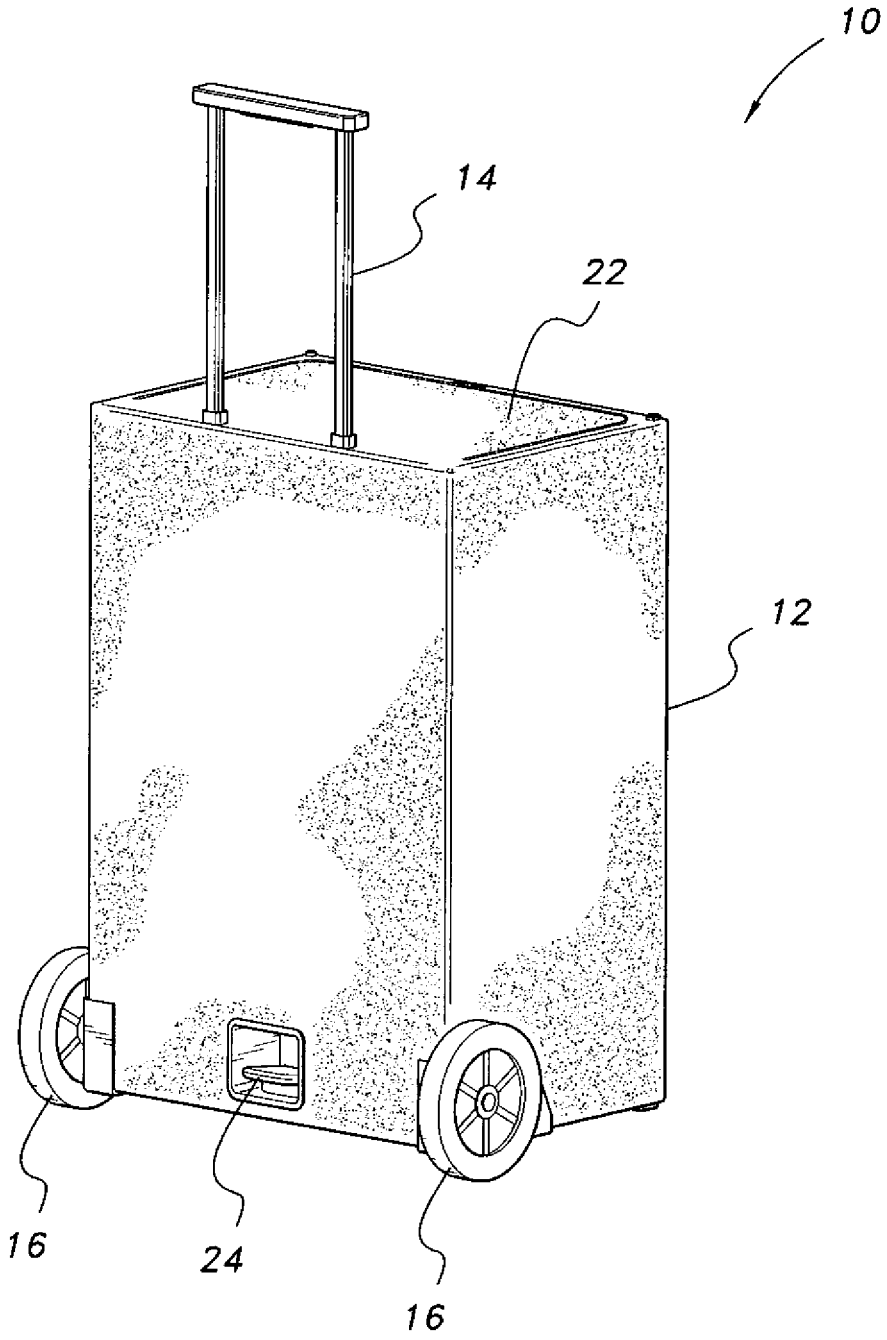
FIG. 2 is a rear perspective view of a luggage and air mattress combination according to the present invention.
Figure 3:
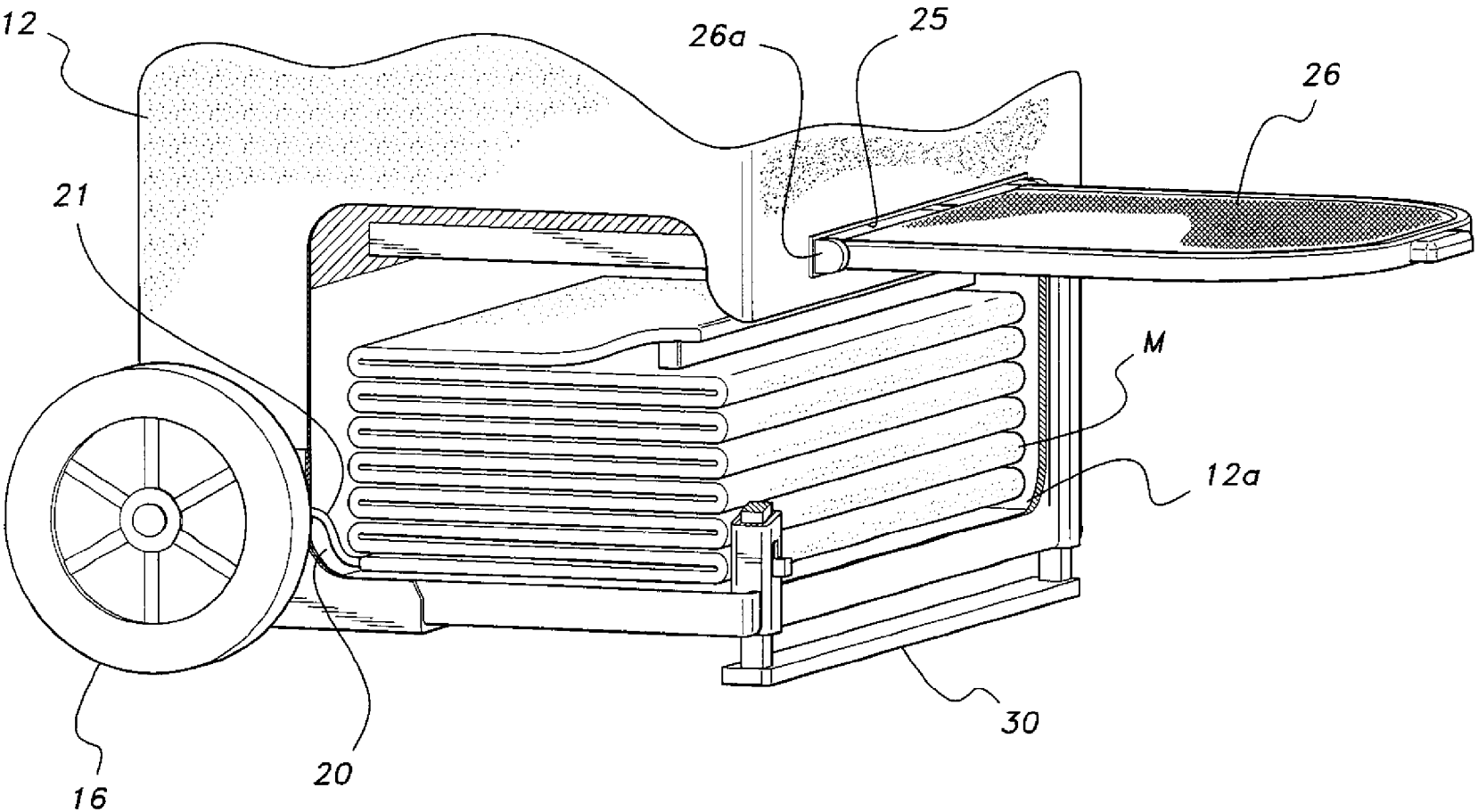
FIG. 3 is a partial perspective view of a luggage and air mattress combination according to the present invention, broken away and partially in section to show details thereof.
Figure 4:
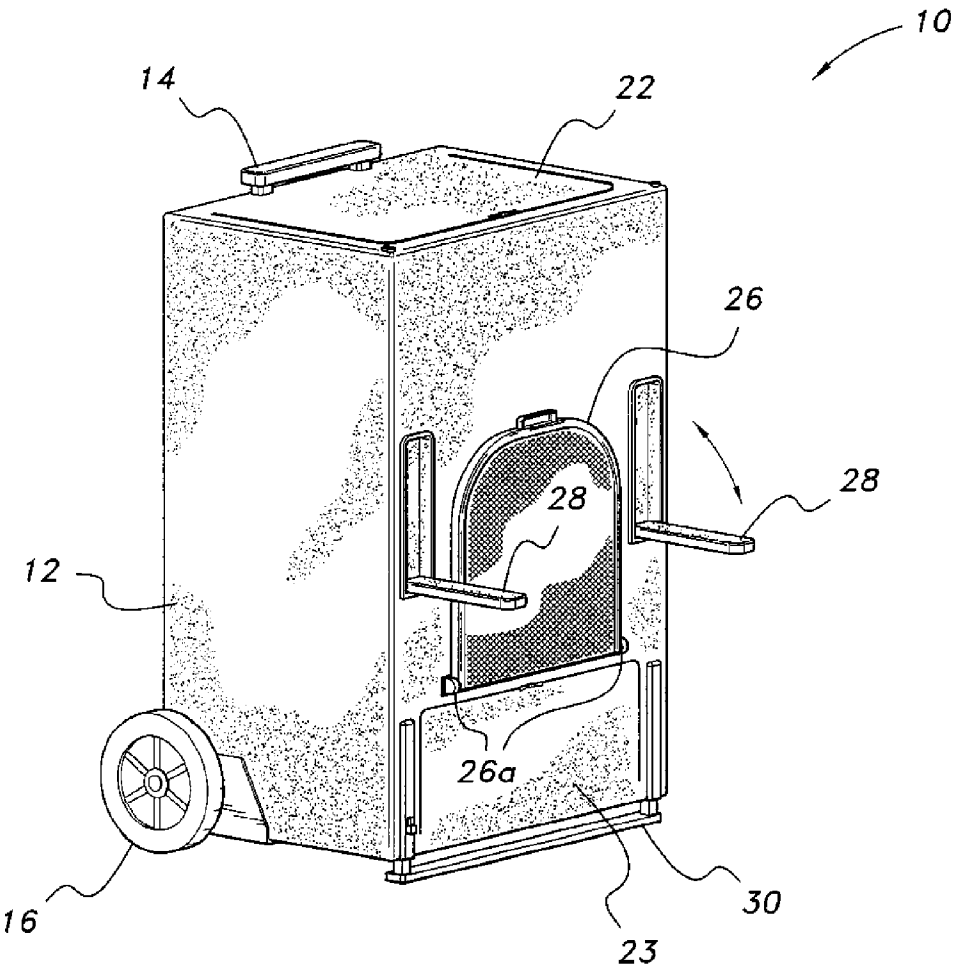
FIG. 4 is a perspective view of a luggage and air mattress combination according to the present invention, showing the backrest and armrests in operable positions.

Referring to FIGS. 1-4 of the drawings, the luggage and air mattress combination, generally indicated at 10, comprises a housing 12 that is provided with a conventional telescoping handle 14. A pair of wheels 16 is positioned on the bottom rear of housing 12 to provide for easy portability for the housing 12. Housing 12 encloses an upper compartment 18 (see FIG. 10) and a lower compartment 20. The upper compartment 18 is openable at its top and is closed by a zippered flap 22. As indicated above, upper compartment 18 is adapted to house personal items. An inflatable mattress M is stored in lower compartment 20. Mattress M can be extracted or extended through an opening 12*a* formed in the lower front surface of the housing 12. A removable flap 23 is utilized to cover opening 12*a* when the mattress M is stored therein. A foot-operated air pump 24 is located in a niche in the rear surface of housing 12 and is connected to mattress M via an airline 21. Although a foot-operated pump is indicated, it should be recognized that other pumps (bicycle, battery-operated, etc.) could be utilized, if suitable. A backrest 26 is stored in housing 12 and can be extracted therefrom through an opening 25 formed in housing 12 immediately above opening 12*a*. Backrest 26 is hinged at 26*a* to allow for pivoted movement to an upright position, as shown in FIG. 4, when fully extracted from the housing 12. Respective arm members 28 are disposed on the front surface of the housing and are positioned on opposite sides of the backrest 26. Arm members 28 can be pivoted from a stored position to a position of use normal to the housing 12. A telescoping foot or braking structure 30 can be lowered from the bottom front edge of the housing 12 to stabilize the housing 12 when desired.

Figure 5:
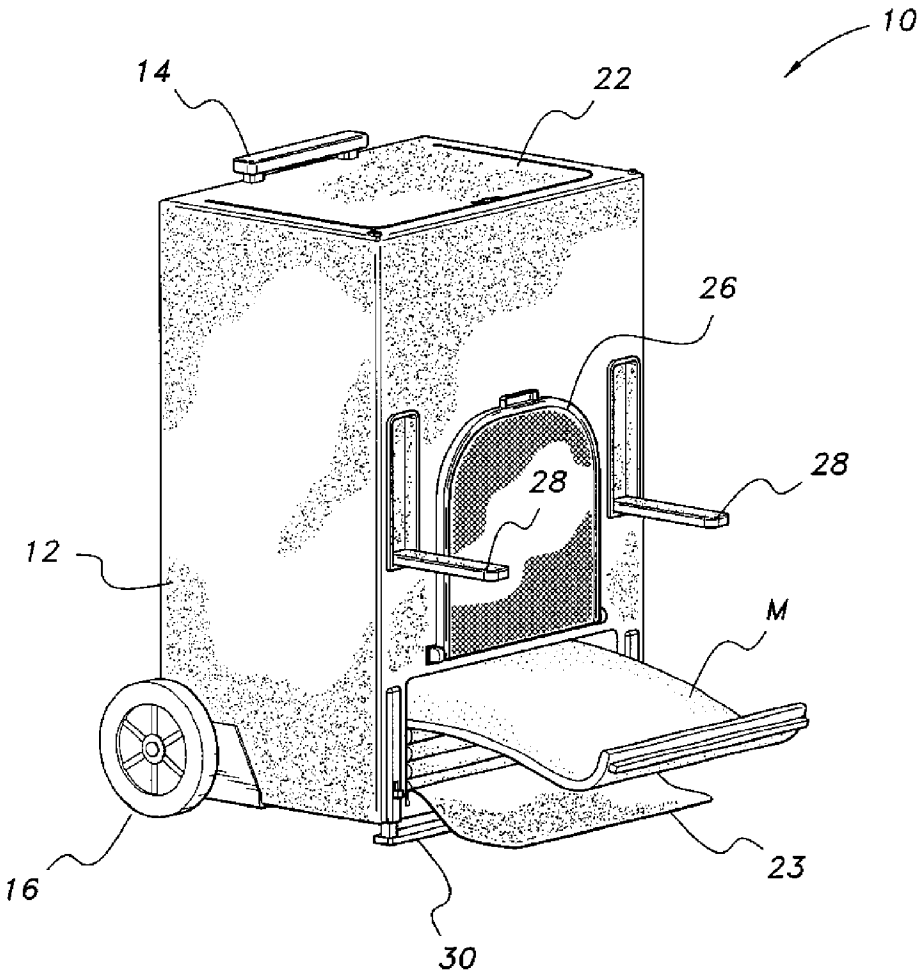
FIG. 5 is a perspective view of a luggage and air mattress combination according to the present invention, showing the mattress in the process of being extended for use.
Figure 6:
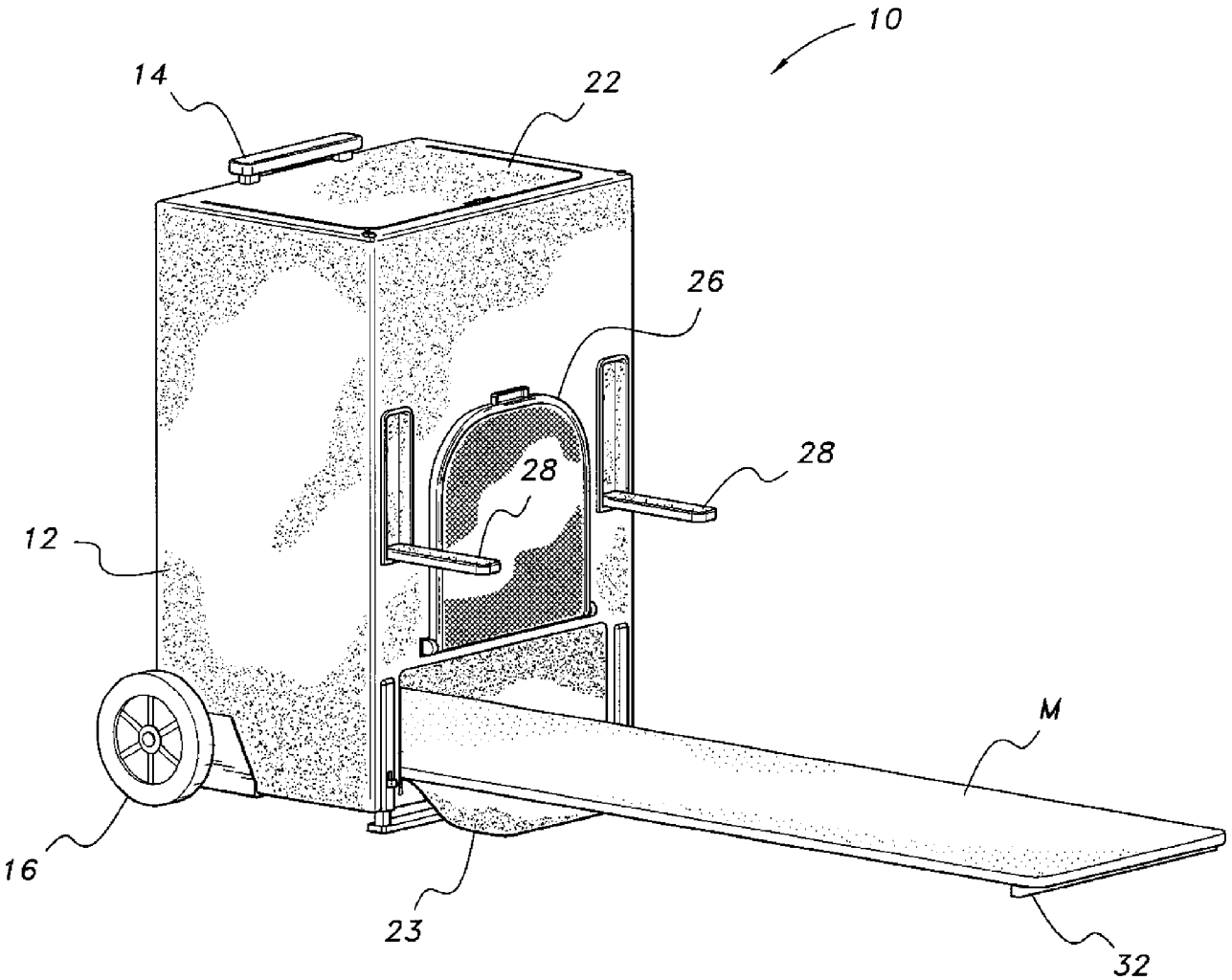
FIG. 6 is a perspective view of a luggage and air mattress combination according to the present invention, showing the un-inflated mattress in a fully extended position.
Figure 7:
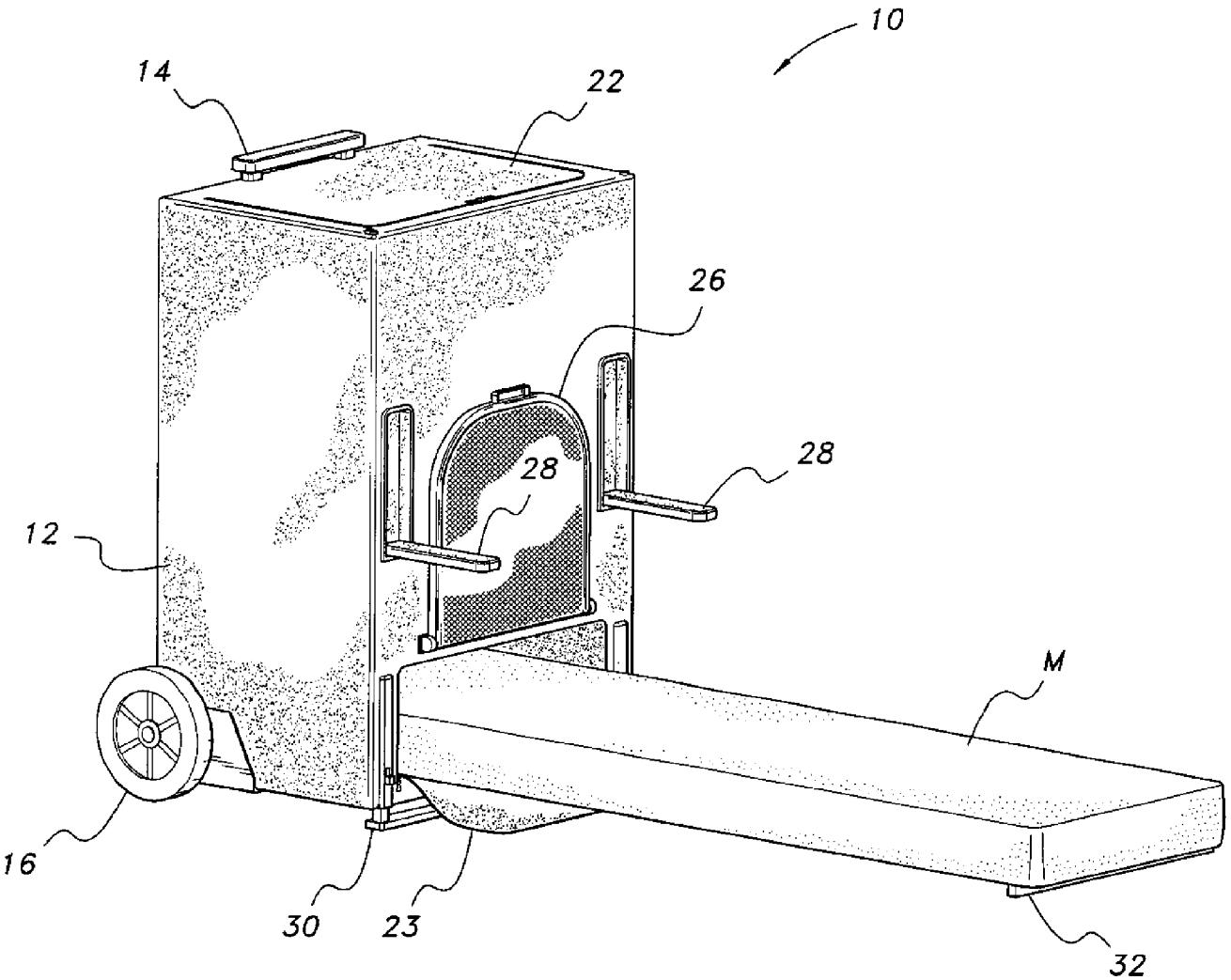
FIG. 7 is a perspective view of a luggage and air mattress combination according to the present invention, showing the mattress in a fully extracted position and inflated for use.

As best seen in FIGS. 5-7, when it is desired to deploy the device in its lounging capacity, backrest 26 and arms 28 are pivoted to their usable positions. Mattress M (un-inflated) is extracted or extended from the housing 12, as shown in FIG. 5, and extended to its full length, as shown in FIG. 6. Pump 24 is utilized to inflate the mattress M for its intended use, as shown in FIG. 7. A foldable foot 32 is employed at the distal end of the mattress on the undersurface thereof to provide support for the mattress M.

Figure 8:
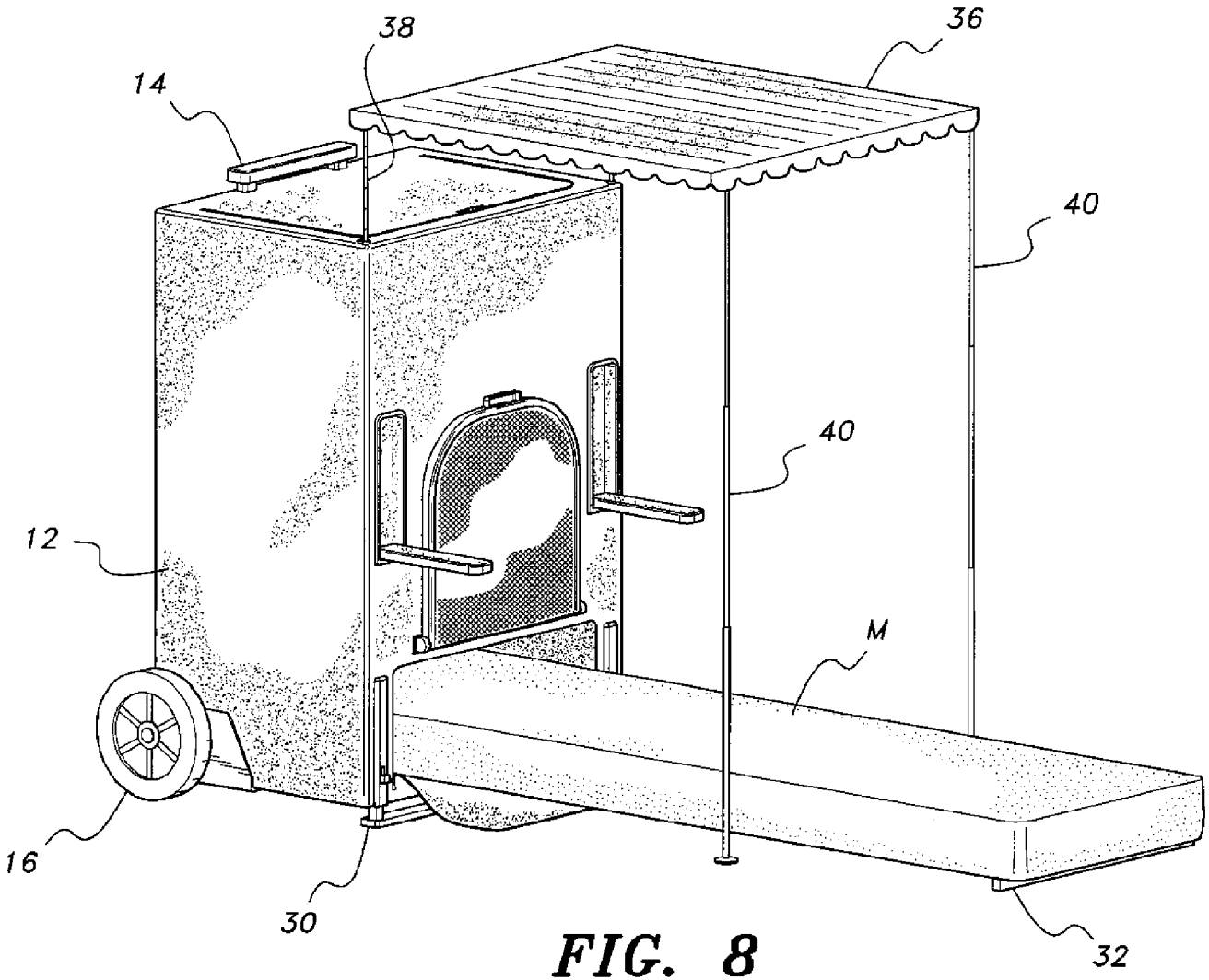
FIG. 8 is a perspective view of a luggage and air mattress combination according to the present invention, showing a canopy deployed above the extended and inflated mattress.
Figure 9:
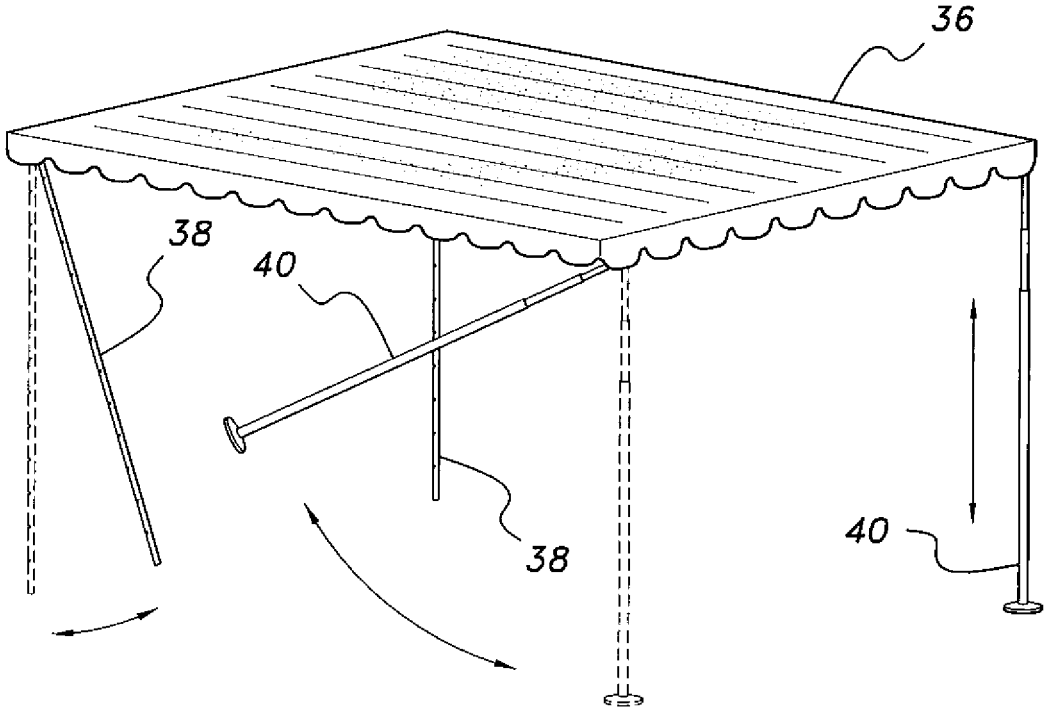
FIG. 9 is a perspective view of the canopy portion of a luggage and air mattress combination according to the present invention.
Figure 10:
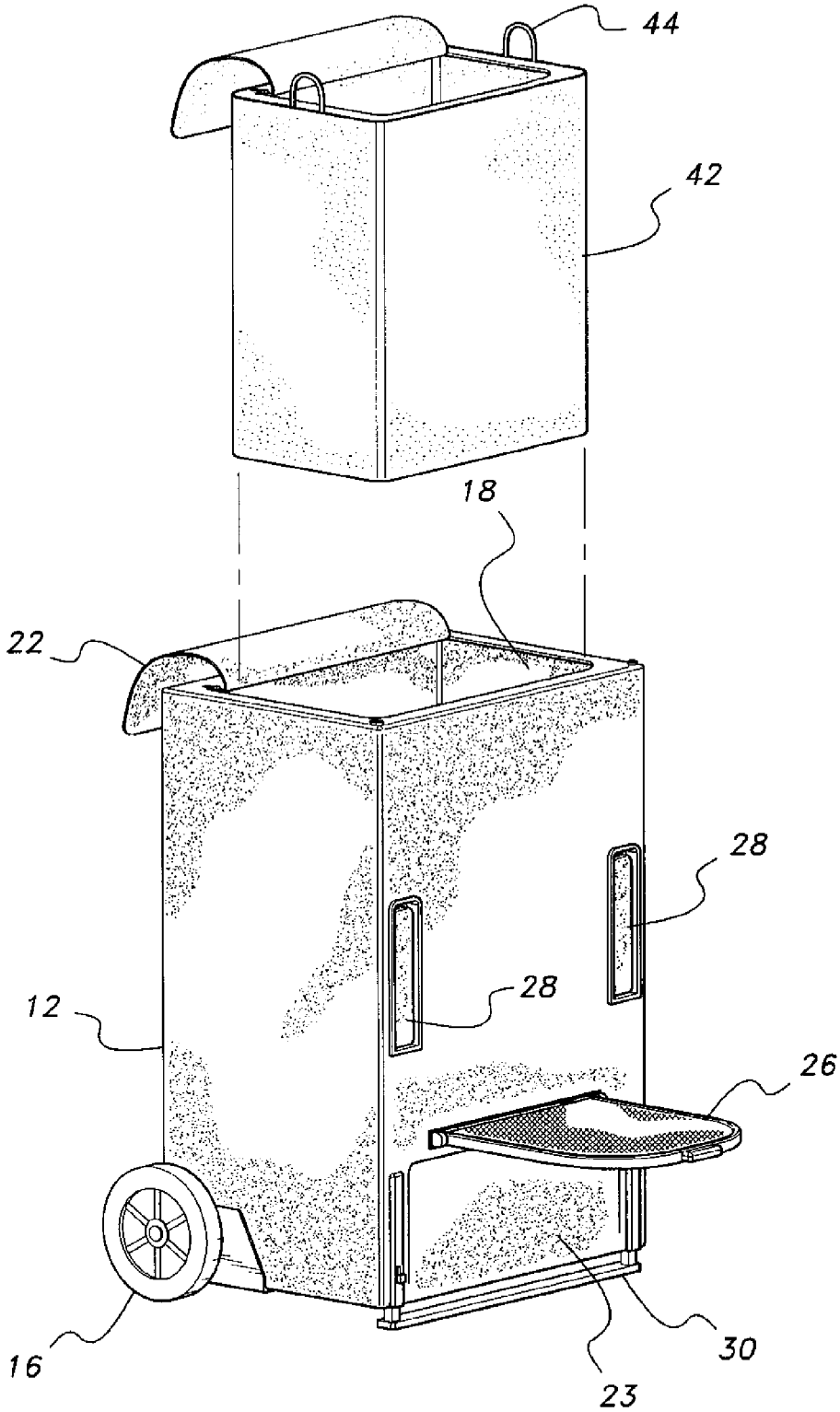
FIG. 10 is an exploded, perspective view of a luggage and air mattress combination according to the present invention, showing a removable liner for use in a luggage and air mattress combination according to the present invention.

FIGS. 8-10 illustrate optional accessories that may be used with the above-described device. A canopy 36, shown in FIGS. 8 and 9, having folding legs 38, 40 is employed to provide a bit of privacy, when desired. The canopy 36 may also function to lessen the effects of overhead lights. Openings are provided in housing 12 to receive rear canopy legs 38. Telescoping legs 40 support the front end of the canopy 36. As presently contemplated, the folded canopy 36 will be attached to the outer surface of the housing 12. A removable, closable liner 42 can be used to store personal items therein. Liner 42 can be insulated, if desired, to provide storage for food. The liner is fashioned with handles 44 to enhance manipulation thereof.

It is to be understood that the present invention is not limited to the embodiment described above, but encompasses any and all embodiments within the scope of the following claims.

I claim:

1. A luggage and air mattress combination, comprising:

a housing having an upper compartment and a lower compartment, the lower compartment having a first opening and a second opening defined therein;

a backrest stored in said lower compartment and extractable through the second opening;

wheels mounted on the housing to enhance portability thereof;

an uninflated air mattress stored in the lower compartment, the mattress being extendable through the first opening in the lower compartment; and a pump disposed in the housing for inflating the air mattress.

2. The luggage and air mattress combination according to claim 1, wherein said pump is a foot-operated pump.

3. The luggage and air mattress combination according to claim 1, further including a pair of arm rests pivotally positioned on said housing.

4. The luggage and air mattress combination according to claim 1, further including a foldable canopy removably attached to said housing.

5. The luggage and air mattress combination according to claim 1, further including a removable liner disposed in said upper compartment.

6. The luggage and air mattress combination according to claim 1, further including a telescoping handle attached to said housing.

7. A luggage and air mattress combination, comprising:

a housing having a front surface, a rear surface, an upper compartment and a lower compartment, the lower compartment having a first opening defined in the front surface;

wheels mounted on the housing at a lower end of the rear surface to enhance portability thereof;

an uninflated air mattress stored in the lower compartment, the mattress being extendable through the first opening in the lower compartment;

a niche formed in the rear surface of said housing, said foot-operated pump being disposed in the niche;

a telescoping handle attached to the housing; and a foot-operated pump disposed in the housing for inflating the air mattress.

8. The luggage and air mattress combination according to claim 7, wherein said lower compartment has a second opening defined therein, the combination further comprising a backrest stored in said lower compartment and extractable through the second opening.

9. The luggage and air mattress combination according to claim 7, further including a pair of arm rests pivotally positioned on the front surface of said housing.

10. The luggage and air mattress combination according to claim 7, further including a foldable canopy removably attached to said housing.

11. The luggage and air mattress combination according to claim 7, further including a closable, removable liner disposed in said upper compartment.

12. A luggage and air mattress combination, comprising:

a housing having a front surface, a rear surface, a lower front edge, an upper compartment and a lower compartment, the lower compartment having a first opening defined in the front surface;

wheels mounted on the housing at a lower end of the rear surface to enhance portability thereof;

an uninflated air mattress stored in the lower compartment, the air mattress having an undersurface and a distal end, the air mattress being extendable through the first opening in the lower compartment;

a folding foot attached to the mattress on the undersurface at the distal end;

a telescoping handle attached to the housing;

a folding canopy removably attached to the housing; and a foot-operated pump disposed in the housing for inflating the air mattress.

13. The luggage and air mattress combination according to claim 12, further including a niche formed in the rear surface of said housing, said foot-operated pump being disposed in the niche.

14. The luggage and air mattress combination according to claim 12, wherein said lower compartment has a second opening defined therein, the combination further comprising a backrest stored in said lower compartment and extractable through the second opening.

15. The luggage and air mattress combination according to claim 12, further including a pair of arm rests pivotally positioned on the front surface of said housing.

16. The luggage and air mattress combination according to claim 12, further including a telescoping foot disposed at the lower front edge of said housing.

17. The luggage and air mattress combination according to claim 12, further including a closable, insulated, removable liner disposed in said upper compartment.

18. The luggage and air mattress combination according to claim 17, further including handles disposed on said removable liner.

* * * * *